US006889975B2

(12) United States Patent
Reist et al.

(10) Patent No.: US 6,889,975 B2
(45) Date of Patent: May 10, 2005

(54) METHOD OF, AND APPARATUS FOR, DEPOSITING SHEET-LIKE PRODUCTS

(75) Inventors: Walter Reist, Hinwil (CH); Willi Leu, Pfaffikon (CH)

(73) Assignee: Ferag AG, Hinwil (CH)

( * ) Notice: Subject to any disclaimer, the term of this patent is extended or adjusted under 35 U.S.C. 154(b) by 158 days.

(21) Appl. No.: 10/220,832

(22) PCT Filed: Jan. 23, 2001

(86) PCT No.: PCT/CH01/00047

§ 371 (c)(1),
(2), (4) Date: Nov. 4, 2002

(87) PCT Pub. No.: WO01/64565

PCT Pub. Date: Sep. 7, 2001

(65) Prior Publication Data

US 2003/0146563 A1 Aug. 7, 2003

(30) Foreign Application Priority Data

Mar. 3, 2000 (CH) ..... 0414/00

(51) Int. Cl.[7] ..... B65H 5/12
(52) U.S. Cl. ..... 271/225
(58) Field of Search ..... 198/408, 377.03, 198/377.04, 457.01, 457.03, 470.1, 471.1; 271/184, 185, 225, 204, 205, 175; 270/52.26, 52.27

(56) References Cited

U.S. PATENT DOCUMENTS

| | | | | | |
|---|---|---|---|---|---|
| 1,258,001 | A | * | 3/1918 | Hammersmith | 271/69 |
| 3,080,956 | A | * | 3/1963 | Salzmann | 198/404 |
| 3,092,380 | A | * | 6/1963 | Anderson et al. | 271/185 |
| 3,713,650 | A | | 1/1973 | Hodgkinson et al. | |
| 3,918,703 | A | * | 11/1975 | Mano et al. | 271/185 |
| 4,238,066 | A | * | 12/1980 | Brooke | 227/39 |
| 4,320,894 | A | | 3/1982 | Reist et al. | |
| 4,322,068 | A | * | 3/1982 | Cayn et al. | 271/207 |
| 4,489,930 | A | * | 12/1984 | Meier | 270/52.3 |
| 4,522,384 | A | * | 6/1985 | Beckley | 270/52.29 |
| 4,736,939 | A | * | 4/1988 | Smerke et al. | 271/184 |
| 5,005,815 | A | * | 4/1991 | Auksi | 270/1.02 |
| 5,065,994 | A | | 11/1991 | Hatt | |
| 5,248,135 | A | | 9/1993 | Leu | |
| 5,292,111 | A | | 3/1994 | Hansch | |
| 5,388,816 | A | | 2/1995 | Petersen | |
| 5,421,699 | A | * | 6/1995 | Guiles et al. | 414/788 |
| 5,462,268 | A | * | 10/1995 | Remy et al. | 271/225 |
| 5,485,989 | A | | 1/1996 | McCay et al. | |
| 6,003,859 | A | | 12/1999 | Reist | |
| 6,186,494 | B1 | * | 2/2001 | Merkli | 271/82 |
| 6,280,104 | B1 | * | 8/2001 | Muller et al. | 400/48 |
| 6,702,100 | B2 | * | 3/2004 | Studer | 198/470.1 |
| 6,726,000 | B2 | * | 4/2004 | Reist et al. | 198/408 |
| 6,736,391 | B1 | * | 5/2004 | Reist | 271/205 |
| 2003/0146564 | A1 | * | 8/2003 | Reist et al. | 271/70 |
| 2004/0061271 | A1 | * | 4/2004 | Leu et al. | 270/52.26 |

FOREIGN PATENT DOCUMENTS

| | | | | |
|---|---|---|---|---|
| DE | 640 559 | | 12/1936 | |
| DE | 640559 | | 12/1936 | |
| DE | 10 35 572 | B | 7/1958 | |
| DE | 10 93 296 | B | 11/1960 | |
| DE | 3318033 | * | 11/1984 | 198/416 |
| EP | 0 476 859 | A2 | 3/1992 | |

(Continued)

*Primary Examiner*—Donald P. Walsh
*Assistant Examiner*—Mark J Beauchaine
(74) *Attorney, Agent, or Firm*—Brinks Hofer Gilson & Lione

(57) ABSTRACT

Method of depositing sheet-like products (2), in particular printed products, which are taking part in a conveying process and follow sequentially one after the other, it being the case that, for at least a period of time of the depositing operation, assisted by gravitational force, the products (2) are pivoted about an axis (B) which extends essentially parallel to the direction in which the conveying process is oriented immediately prior to the depositing operation.

16 Claims, 9 Drawing Sheets

FOREIGN PATENT DOCUMENTS

Figure 1:
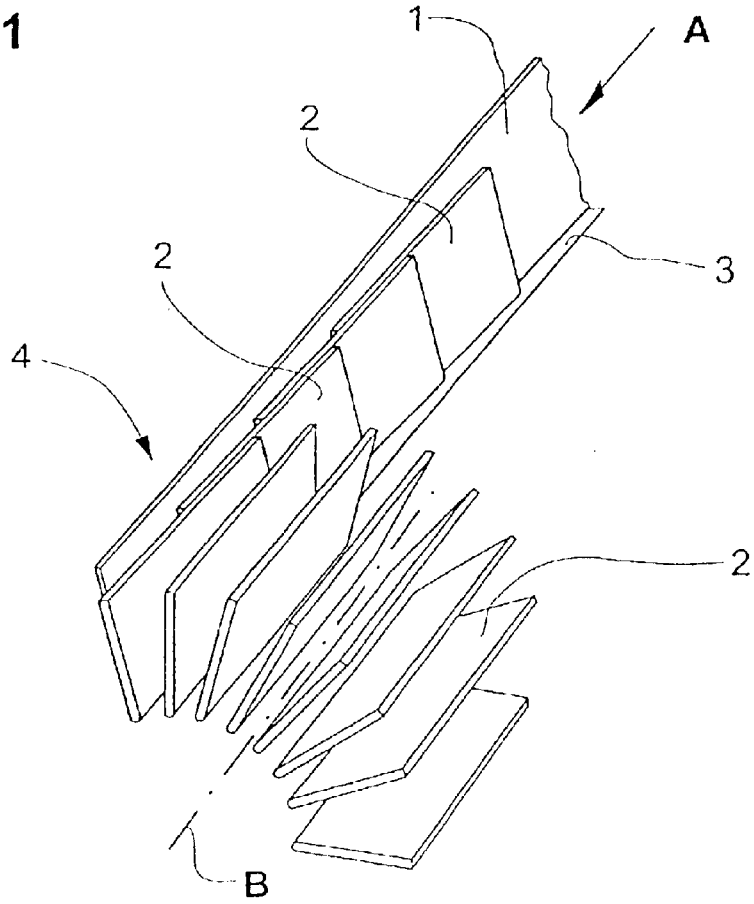

| | | | | |
|---|---|---|---|---|
| EP | 0 572 221 A1 | | 12/1993 | |
| EP | 0 644 142 A1 | | 3/1995 | |
| EP | 0644142 A1 | * | 3/1995 | ..... B65H/29/04 |
| EP | 0 708 042 A1 | | 4/1996 | |
| GB | 2242185 | * | 9/1991 | ..... B65H/29/40 |
| JP | 3-111372 | * | 5/1991 | ..... 271/184 |
| JP | 5-127357 | * | 5/1993 | ..... 271/184 |
| JP | 5-270745 | * | 10/1993 | ..... 271/184 |

* cited by examiner

METHOD OF, AND APPARATUS FOR, DEPOSITING SHEET-LIKE PRODUCTS

CROSS REFERENCE TO RELATED APPLICATIONS

This application is a nationalization of PCT application PCT/CH01/00047 filed Jan. 23, 2001. This application claims priority from the PCT application and Swiss Patent Application. No. 2000 0414/00 filed Mar. 3, 2000.

BACKGROUND OF THE INVENTION

The invention relates to a method of, and an apparatus for, depositing sheet-like products, in particular printed products, which are taking part in a conveying process and follow sequentially one after the other.

In certain application cases, it is necessary for products transported, for example, on a conveying belt to be turned through 180° in relation to an axis parallel to the conveying direction. This is achieved according to the prior art, for example, by so-called "rotary belts" in which the products are retained between two belts which are twisted parallel to one another through 180° along the conveying direction. In order to avoid damage to the products and to ensure reliable turning, these rotary belts have to extend over a relatively large region of the conveying belt, which is disadvantageous in respect of the amount of space taken up by the turning apparatus.

In other application cases, it is necessary for the conveying direction of products transported, for example, on a conveying belt to be changed abruptly by a predetermined angle, in particular by an angle of 90°. According to the prior art, this is achieved, for example, in that running at the end of a first conveying belt is a second conveying belt, which extends at right angles to the first conveying belt and of which the conveying plane is arranged beneath the conveying plane of the first conveying belt, with the result that the products can drop onto the second conveying belt and thus change their conveying direction by 90°. It is disadvantageous here, for example, that the products drop between the two conveying planes in an uncontrolled manner, which may result in disruption. It is further disadvantageous that for example, if when the conveying direction is changed, upstream or downstream, the products are also to be turned, this can only be achieved by means of separate turning apparatuses or rotary belts, which in turn is disadvantageous in respect of the amount of space taken up. The same applies if when the conveying direction is changed, upstream or downstream, the products are to be rotated about an axis running perpendicularly to the conveying plane or a combination of the abovementioned operations of changing the conveying direction, turning and/or rotating are to take place in any desired time sequence.

BRIEF SUMMARY OF THE INVENTION

It is an object of the invention to develop a method of the type mentioned in the introduction such that products supplied sequentially by a conveying means can be processed further individually with reduced mechanical outlay, the intention being to avoid in particular high accelerations of the products during the depositing operation. It is additionally intended for it to be possible for the method to be implemented in the smallest possible amount of space.

This object is achieved according to the invention in that, for at least a period of time of the depositing operation, assisted by gravitational force, the products are pivoted about an axis which extends essentially parallel to the direction in which the conveying process is oriented immediately prior to the depositing operation.

At the beginning of the depositing operation, a redirection of the movement of the products thus takes place to the effect that the forward movement brought about by the conveying process is slowed down, and a laterally oriented pivoting movement commences during this slowing-down operation. This pivoting movement, which is oriented laterally in relation to the direction of the conveying process, is assisted by gravitational force at least for a period of time of the depositing operation, which ultimately means that the products are pivoted downward during this period of time and, once the abovementioned period of time has elapsed, have less potential energy than prior to this period of time.

Since the pivoting of the products commences in each case when a product arrives at a defined position or at the end of the conveying means, all the products are pivoted individually one after the other, with the result that, with products following one after the other quickly or in imbricated formation, a fan-like structure is produced during the pivoting operation, each fan element of said structure being formed by precisely one product in each case, with the result that it is easily possible for the individually fanned-out products to be further processed individually. This is because, once the products have executed the pivoting movement according to the invention, they can easily be, for example, gripped and removed individually from their individually fanned-out structure or deposited individually on a further conveying means.

Instead of individual products being conveyed and pivoted, it is also possible for groups of products to be conveyed and/or pivoted in each case. The product groups here may be formed during the conveying operation preceding the pivoting operation, with the result that even the conveying operation takes place in groups. It is also possible, however, for the product groups only to be formed immediately prior to commencement of the pivoting operation or even during the pivoting operation, which means that, shortly prior to or during the pivoting operation, individual products following one after the other, for example, in imbricated formation are pushed essentially congruently one above the other to form groups.

The pivoting movement provided according to the invention further achieves the situation where the transfer between two conveying means which follow sequentially one after the other can take place with an extremely small amount of space being required since the two conveying means only need to overlap one another slightly, this overlapping being, for example, in the order of magnitude of the longitudinal extent of a product in the conveying direction. An arrangement in which the two conveying means following one after the other extend in parallel, which requires a large amount of space, for the purpose of transferring products, e.g. from a conveying part to a gripper section, is avoided altogether according to the invention.

It is advantageous if the pivot axis which is decisive for the pivoting movement according to the invention coincides at least essentially with a product edge which extends parallel to the direction in which the conveying process is oriented immediately prior to the depositing operation. In this case, the products are pivoted about one of their edges, which, on the one hand, means that the pivoting movement can be executed with a minimal amount of space being required and, on the other hand, advantageously results in the products only having to be accelerated to an unproblematic extent. In this case, the edge about which the pivoting movement takes place is advantageously not accelerated at all in practice.

Immediately prior to the beginning of the depositing operation, the products may be oriented horizontally or in a manner inclined in relation to the horizontal. It is advantageous if the products are oriented in an inclined manner such that they are located virtually in a vertical plane, but still rest with their surface area on the conveying means. In this case, all that is required, at the beginning of the pivoting movement, is for the products to overcome a small angle range, for example between 5° and 20°, until the pivoting movement assisted by gravitational force can commence.

It is likewise possible, however, to convey the products by means of grippers, which then transfer the products, for the purpose of the pivoting operation according to the invention, to a corresponding pivoting apparatus. These grippers can retain the products, for example, at their top edge and convey them in the hanging state. It is also possible, however, for the grippers to retain the products at any other desired edge.

Throughout the pivoting movement, the products are preferably pivoted through an angle of between 90° and 270°, that part of the pivoting movement which is assisted by the gravitational force usually always accounting for an angle range of between 90° and 180°. It is thus possible according to the invention for the products to be pivoted downward, assisted by gravitational force, through an angle range of between 90° and 180°, it optionally also being possible for this to be preceded by an operation of raising the products through up to 90°, this taking place by overcoming the gravitational force.

During the conveying process preceding the pivoting movement, the products may be transported both in imbricated formation and without overlapping one another. In order to implement the method according to the invention, all that is necessary is for the individual products to follow sequentially one after the other.

In order for it to be possible for the pivoting movement according to the invention to be executed in a defined manner, it is possible, during this pivoting movement, for the products to be retained at least temporarily, in particular at their leading edge, as seen in the conveying direction, by suitable means, e.g. by supporting means or grippers, which pivot along with the products. In particular each product here is assigned an individual gripper, of which the movement, ultimately, determines the speed of the pivoting movement of the products. By means of the abovementioned grippers, it is additionally possible, at the beginning of the pivoting movement, for the products to be pivoted upward over the above-mentioned angle range of between 0° and 90°, the gravitational force being overcome in the process. Immediately prior to the beginning of the pivoting movement, the products may be moved, by way of their leading edge, into the gripper by the conveying movement. It is likewise possible for a suitable apparatus to guide the grippers, counter to the conveying movement, up to the leading edge of the products in order then to grip the latter.

Particularly cost-effective functioning of the method according to the invention is achieved when, during the pivoting movement, the products are processed, in particular opened, stapled, addressed, cut or the like. In this case, the pivoting movement is not just utilized for lifting off the products from the conveying means; at the same time, it is also possible for processing to take place during the pivoting movement, time being saved in this way.

If folded products are opened during the pivoting movement, it is advantageous if the fold region of the products ends up in the radially inward direction in relation to the pivoting movement. In a particular variant of the method according to the invention, it is then possible, during the pivoting movement, for already open products to have further products inserted into them.

It is preferred if, at the beginning of the depositing operation, the products are moved, by way of their leading edge, against an in particular stationary stop, with the result that the products, at least in certain regions, lift off from the conveying means in the pivoting direction. This stop thus initiates the pivoting movement according to the invention in that, for example in a region of the leading edge of the products which is directed away from the pivot axis, it prevents further movement in the conveying direction, which results in the products "bulging out" on account of the action of friction between the conveying means and products. This bulging out takes place in each case in a defined direction away from the conveying means, with the result that the abovementioned stop triggers a controlled and defined initiation of the pivoting movement, whereupon the rest of the pivoting movement can then take place either exclusively with the assistance of gravitational force or in a controlled manner by way of a gripper.

It is particularly preferred if, at the beginning of the depositing operation, products having an overfold are only moved against a stop of the above-mentioned type by way of the leading edge of their overfold region, with the result that that region of the products which is located opposite the overfold lifts off from the overfold in the pivoting direction and the products are thus made to open. In this case, the stop thus results both in the pivoting movement being initiated and in the products being opened.

Following the pivoting movement according to the invention, the products may be deposited, for example, on a further conveying means or else also on a product stack. If the products are deposited on a conveying means, the conveying direction of this further conveying means may run essentially perpendicularly, or else also parallel, to the direction in which the conveying process was oriented immediately prior to the depositing operation. The conveying direction of the products may thus be changed, for example, by 0°, 90°, 180° or 270° by means of the method according to the invention. The further conveying means may be designed, for example, as a pocket conveyor, as a saddle conveyor, as a combined pocket and saddle conveyor or else also as a conveying belt.

Further preferred embodiments of the method according to the invention are described in the subclaims.

BRIEF DESCRIPTION OF THE SEVERAL VIEWS OF THE DRAWING(S)

Figure 2:
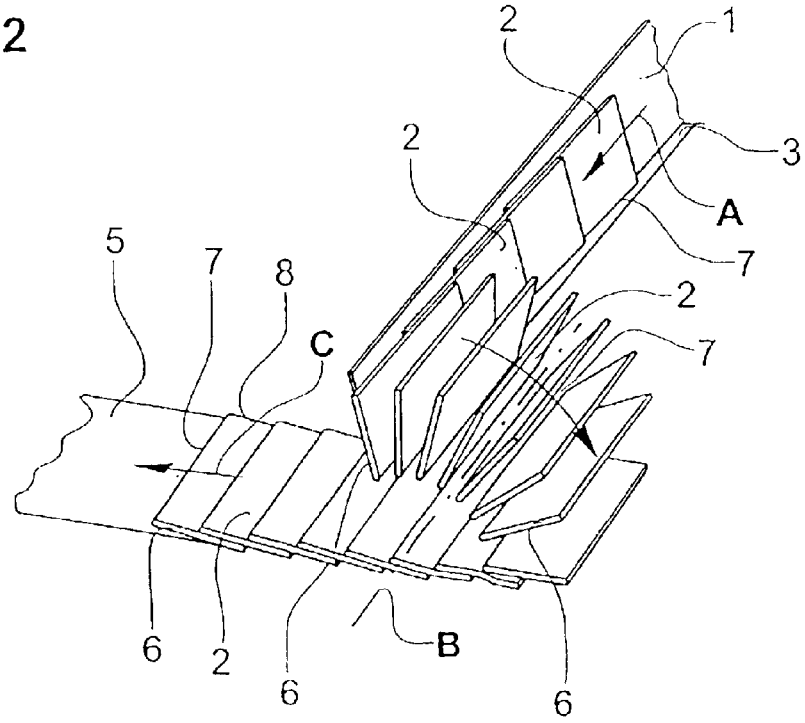
Figure 3:
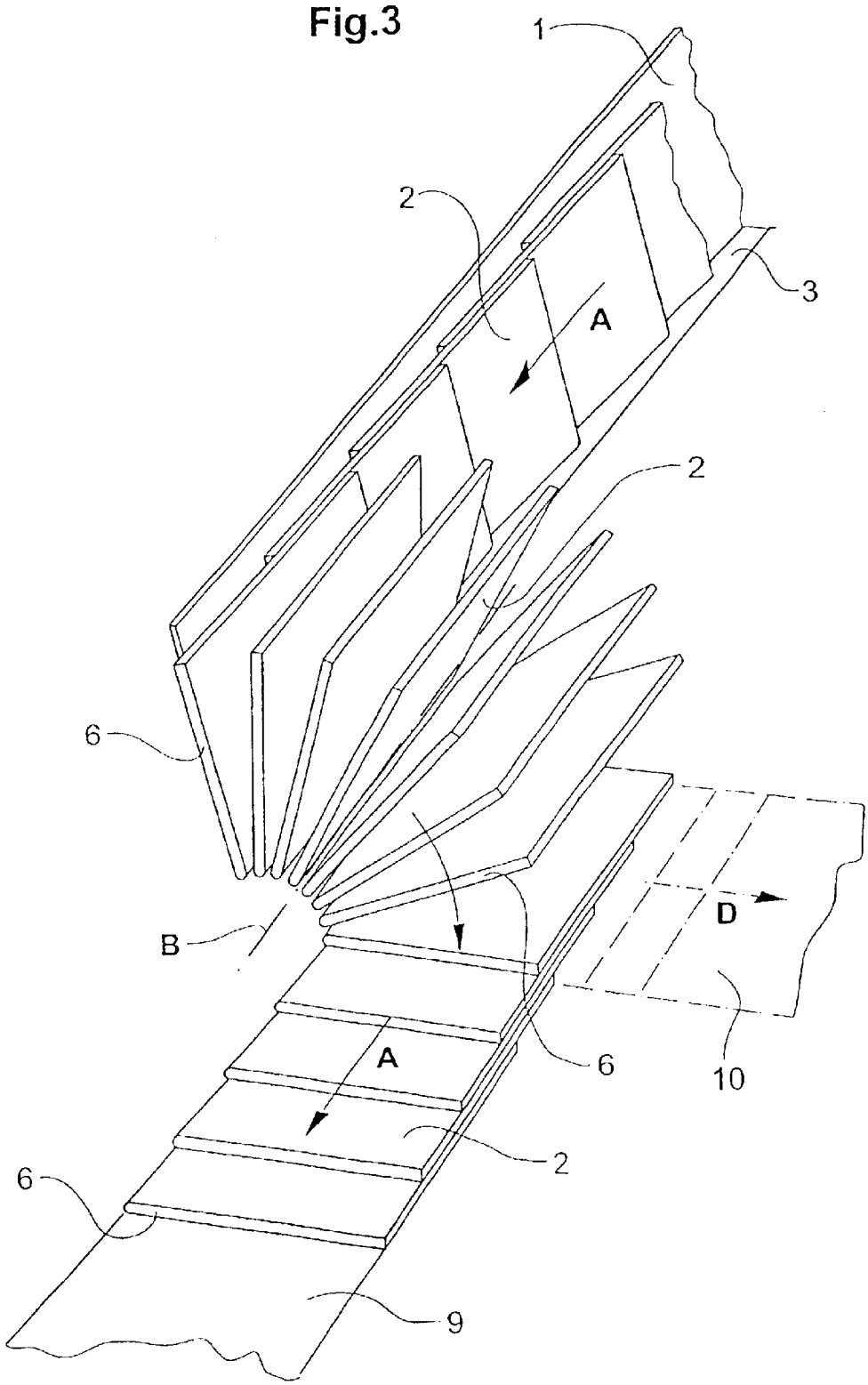
Figure 4:
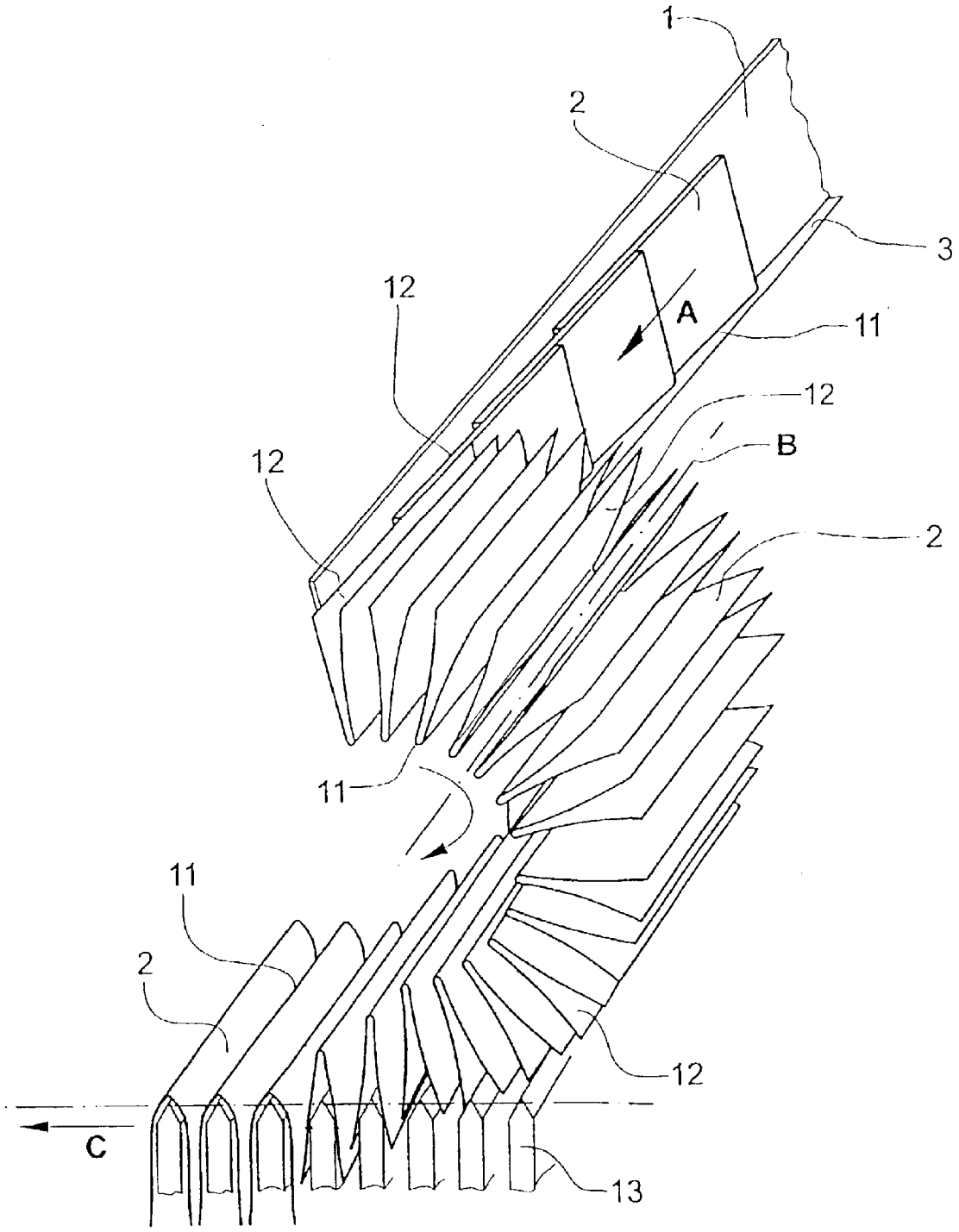
Figure 5:
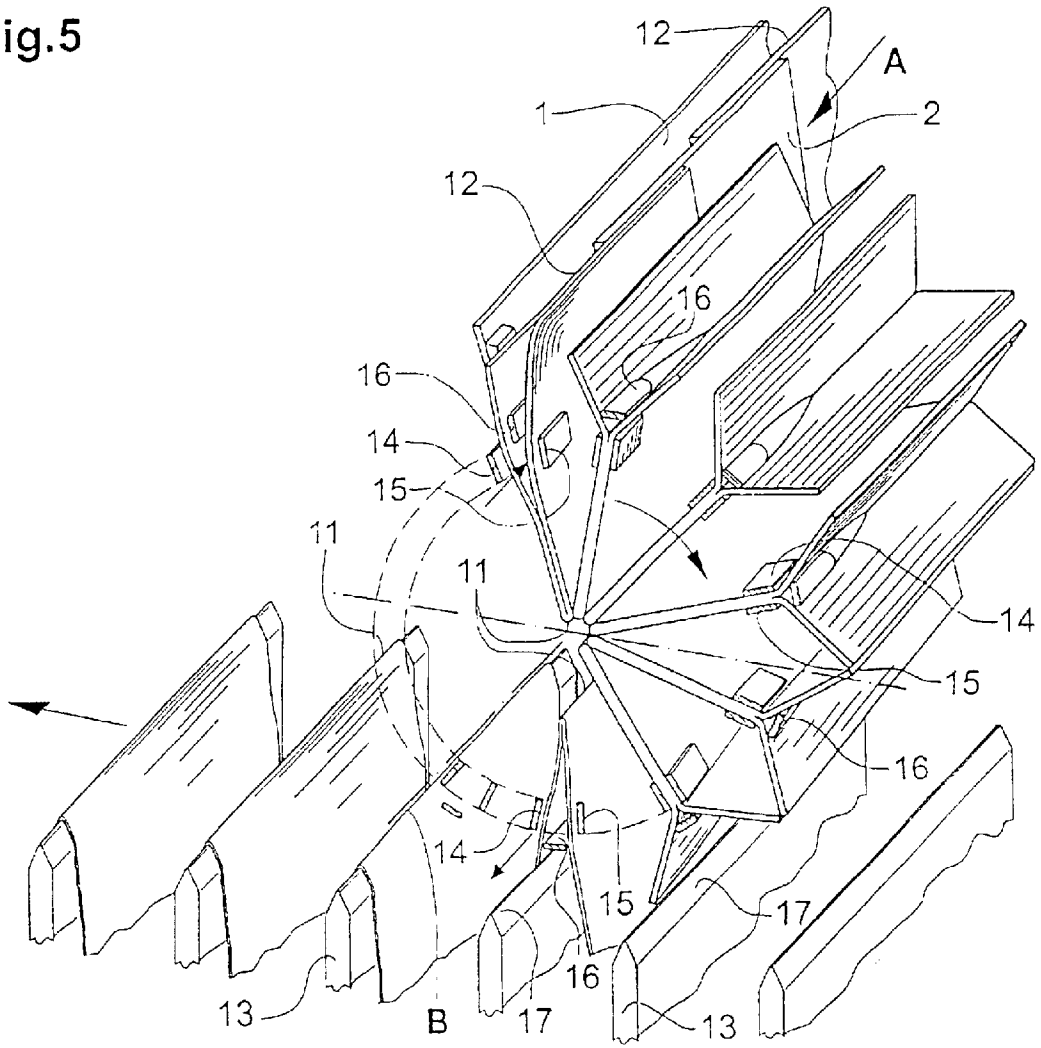
Figure 6:
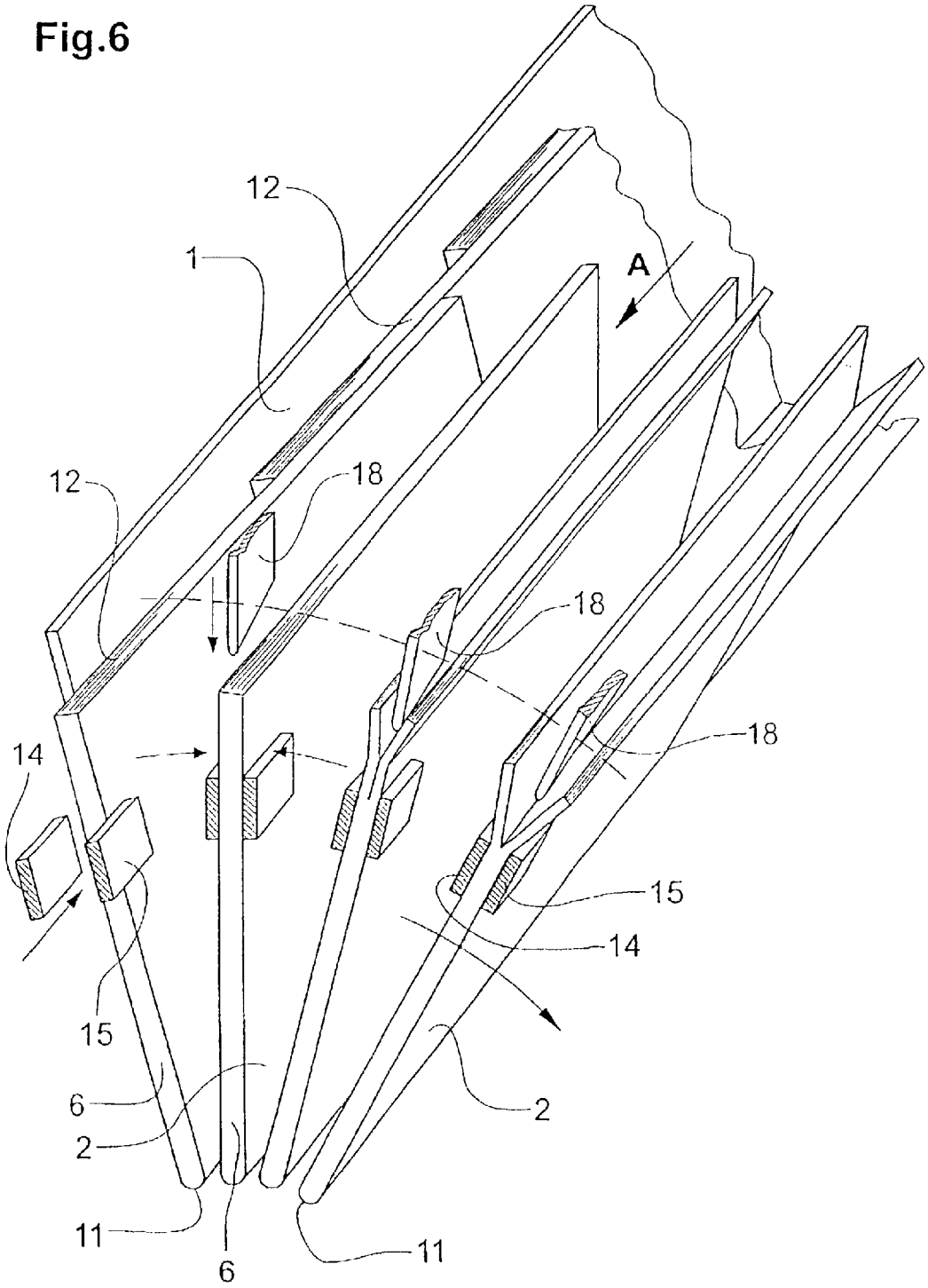
Figure 7:
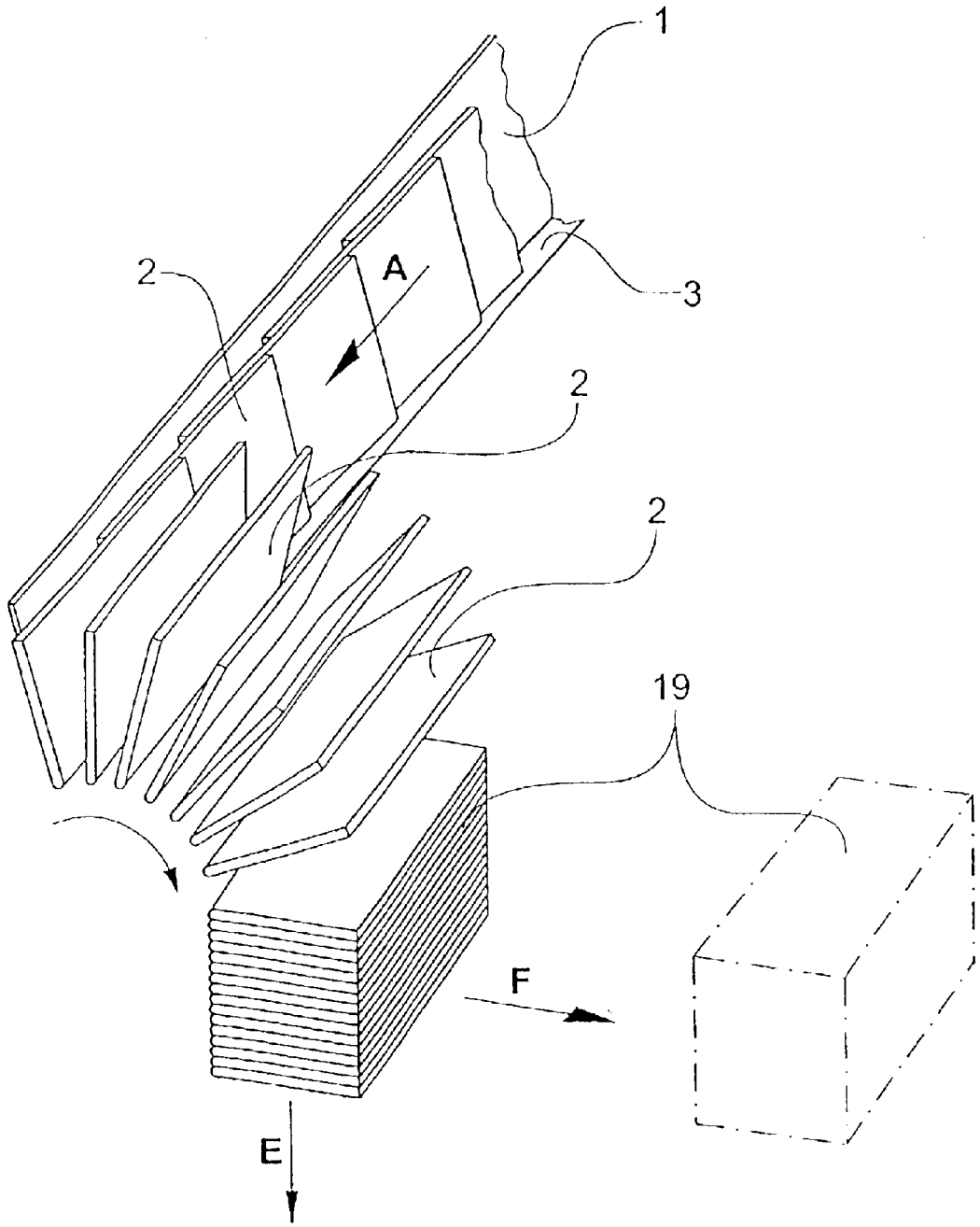
Figure 8:
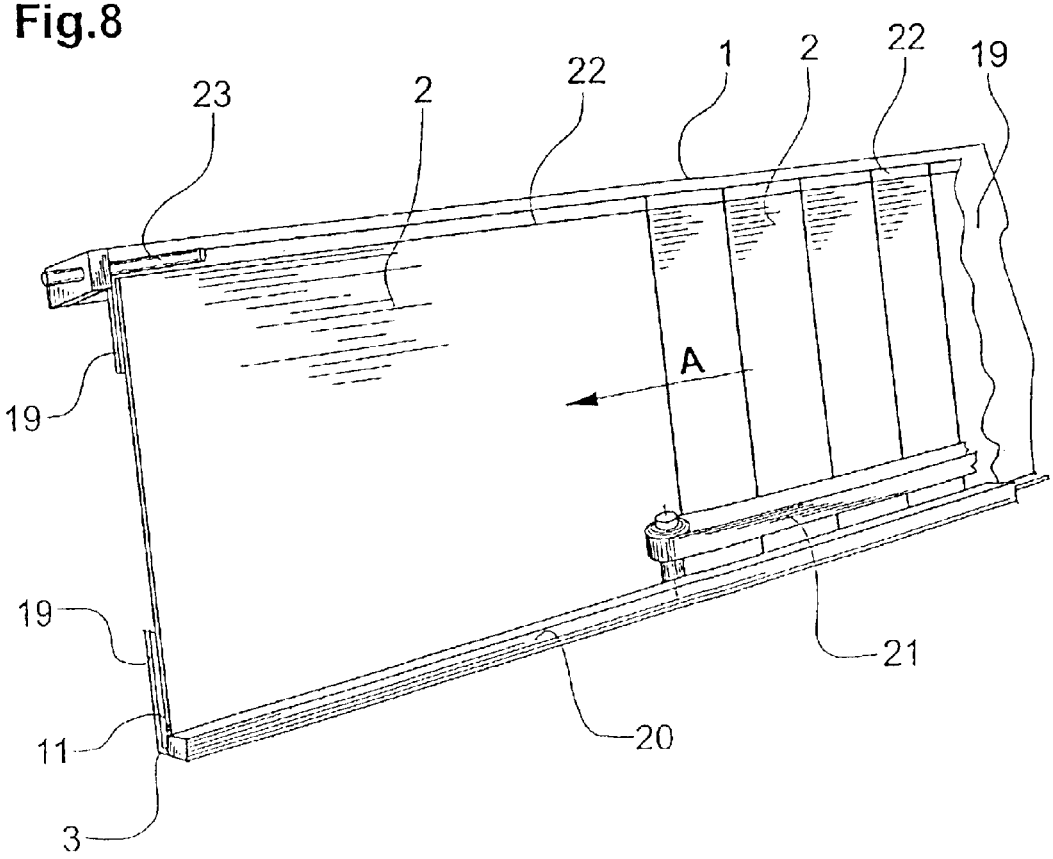
Figure 9:
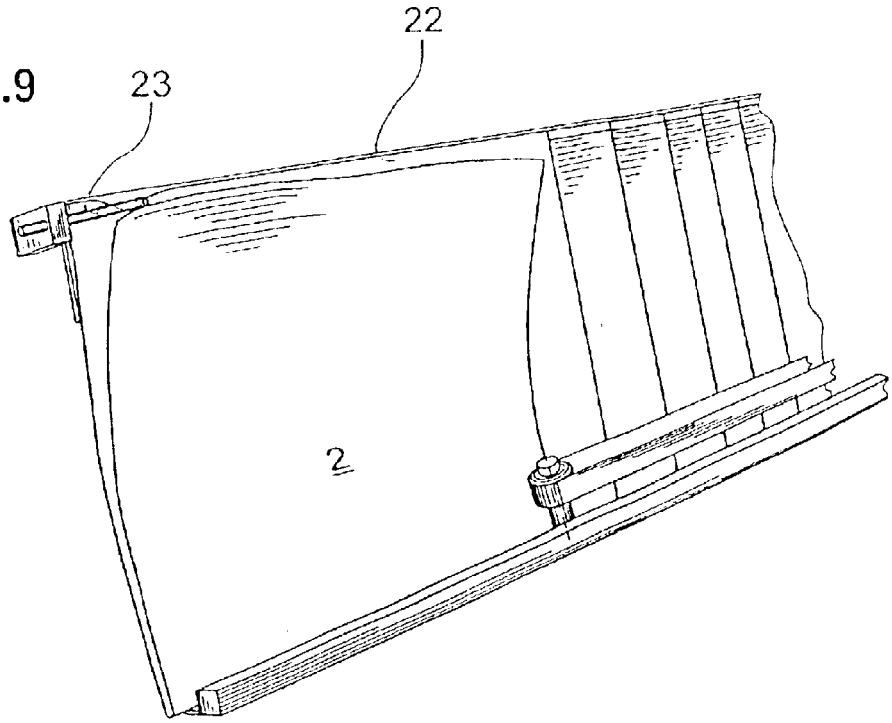
Figure 10:
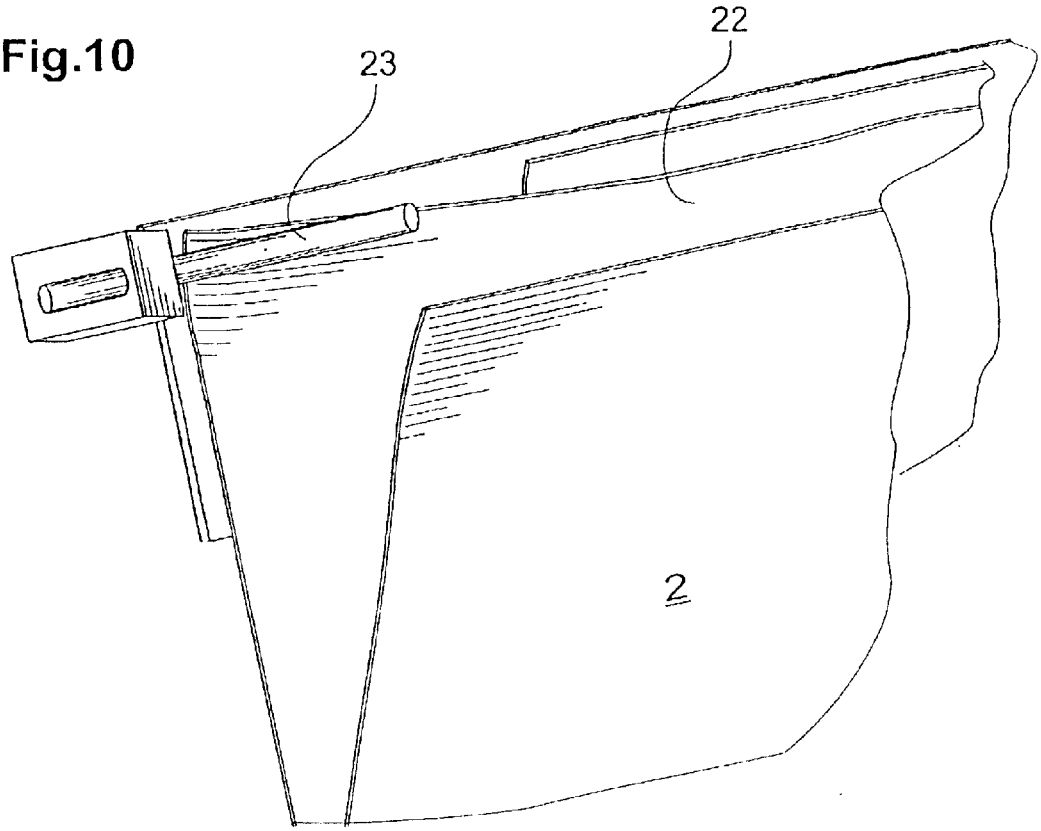
Figure 11:
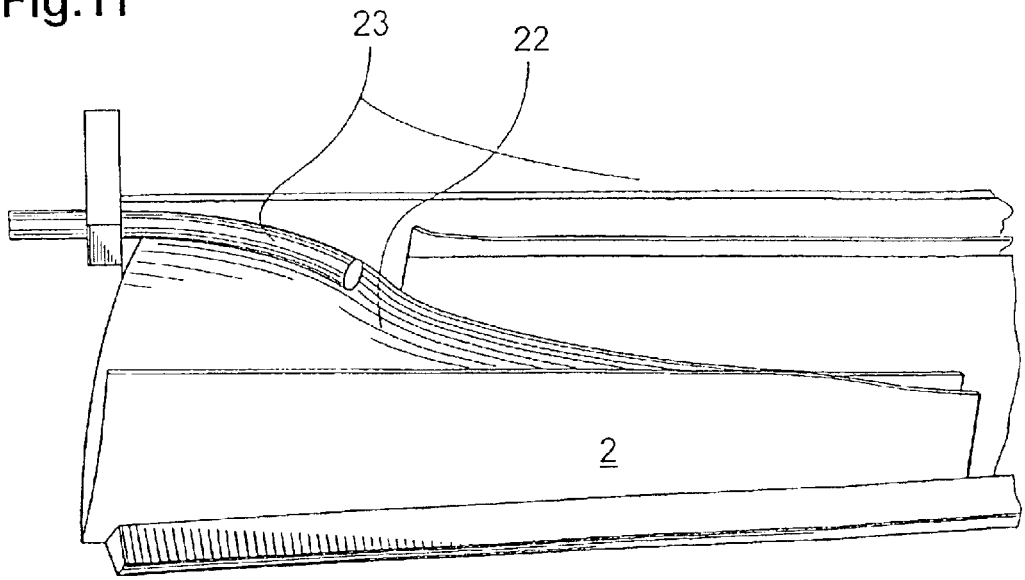
Figure 12:
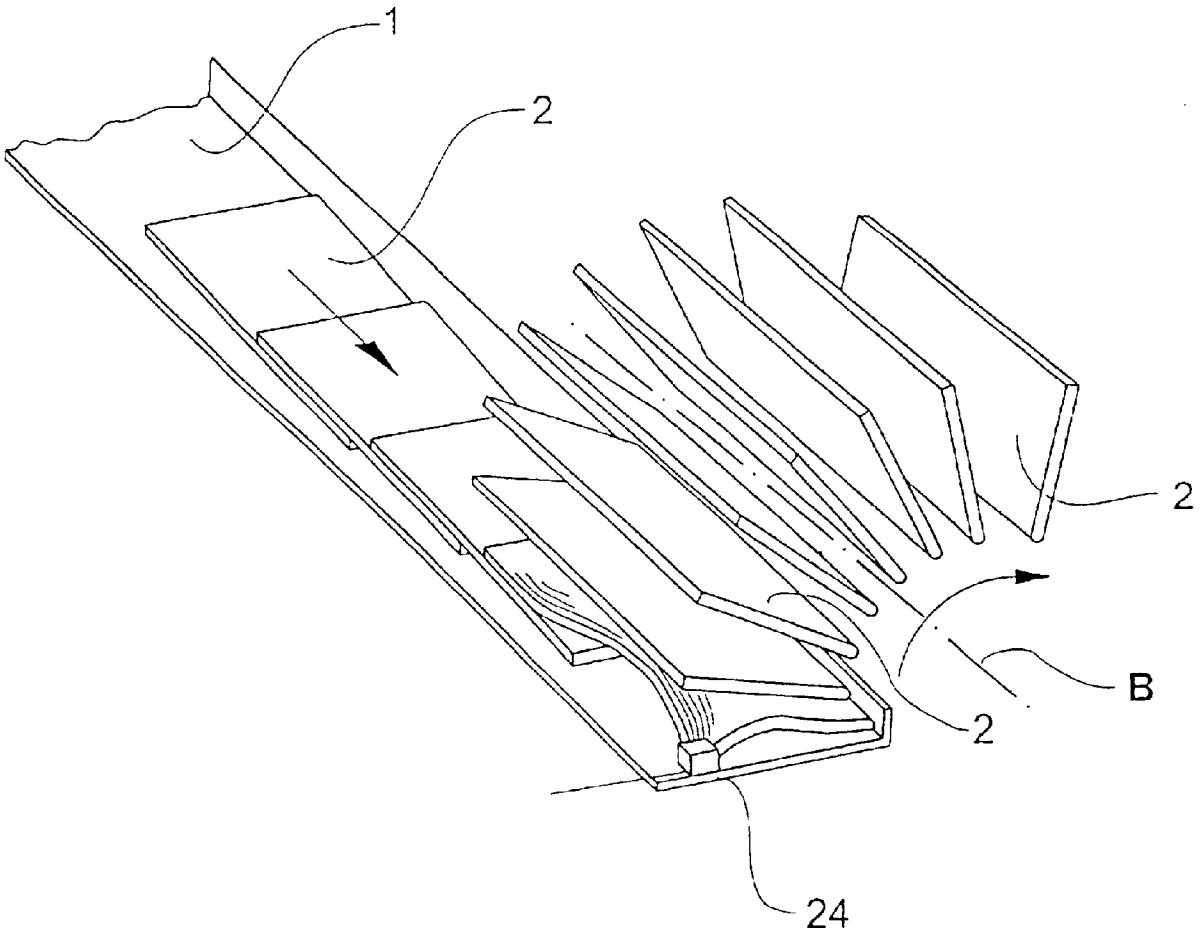

The invention is explained hereinbelow by way of exemplary embodiments and with reference to the drawings, in which:

FIG. 1 shows a schematic illustration of the course taken by a method according to the invention with a conveying means, FIG. 2 shows an illustration according to FIG. 1 with an additional further conveying means, FIG. 3 shows an illustration according to FIG. 2 with an alternative further conveying means, FIG. 4 shows an illustration according to FIG. 1, incorporating an opening process with a further conveying means designed as a saddle conveyor, FIG. 5 shows an illustration according to FIG. 4, with a detailed illustration of the opening process, FIG. 6 shows a schematic illustration of an opening process with alternative means to FIG. 5, FIG. 7 shows a schematic illustration of a method according to the invention used for stack formation, FIG. 8 shows a conveying means, which can be used within the context of the invention, with a stop arranged in its end region, the conveying means being shown in a first method step, FIG. 9 shows an illustration according to FIG. 8 in a second method step, FIG. 10 shows an illustration according to FIG. 8 in a third method step, FIG. 11 shows an illustration according to FIG. 8 in a fourth method step, and FIG. 12 shows a schematic illustration of the course taken by a method according to the invention, with a horizontally oriented conveying means having a stop at its end.

DETAILED DESCRIPTION OF THE INVENTION

FIG. 1 shows a schematic illustration of a conveying means 1 which is inclined slightly in relation to the vertical and by means of which printed products 2 are moved in imbricated formation in the conveying direction A. The printed products 2 here are positioned with their surface area against the conveying means 1 and are supported at their bottom edge via a supporting lug 3, which extends essentially perpendicularly to the plane of the printed products 2.

The printed products 2 are moved, by the conveying means 1, into the end region 4 of the latter, where the movement of the printed products 2 in the conveying direction A terminates and a pivoting movement about the axis B, which extends parallel to the conveying direction A, commences. The pivot axis B may coincide with the bottom edge of the products 2 supported on the supporting lug 3; however, it is also possible—as is illustrated in FIG. 1—for it to be spaced apart from the abovementioned edge.

FIG. 1 shows that, at the beginning of the pivoting movement, gravitational force being overcome in the process, the products 2 have to be raised by the conveying means 1 over a small angle range until they are located essentially vertically, whereupon the rest of the pivoting movement can take place in the downward direction, assisted by gravitational force, with potential energy being dissipated in the process.

FIG. 2 shows an illustration corresponding to FIG. 1 with a further conveying means 5 designed as a conveying belt, the conveying direction C of this further conveying means 5 being oriented perpendicularly to the conveying direction A of the conveying means 1. Both conveying directions A and C extend in the horizontal direction in each case.

In the exemplary embodiment shown in FIG. 2, the products 2 are pivoted, with the assistance of gravitational force, over an angle range of approximately 90°, with the result that, at the end of their pivoting movement, the products 2 end up in a horizontal plane which coincides with the conveying plane of the further conveying means 5. This conveying plane extends beneath the conveying means 1.

The products 2 are transported by the conveying means 1 such that one of their shorter edges 6 precedes, while they are supported on the supporting lug 3 via the bottom of their longer edges 7. The operations of pivoting the products 2 according to the invention and thus of depositing the same on the further conveying means 5 achieve the situation where the longer edge 7 via which the products 2 were supported in the conveying means 1 leads in the region of the further conveying means 5. The method according to the invention can thus achieve the situation where a product which is transported up with the shorter edge 6 leading can be transported further with a longer edge 7 leading.

It is conceivable, for example at the end of the further conveying means 5, also to provide a further apparatus for implementing the method according to the invention, which further apparatus could then, in turn, cause the products to be transported further by a third conveying means with their shorter edge 6 leading or with the shorter edge 8, which is located opposite said shorter edge 6, leading.

FIG. 3 shows an illustration corresponding to FIG. 2 and illustrates that, following the operation of pivoting the products 2 according to the invention, it is also possible to use a further conveying means 9, which continues to transport the products 2 in direction A of the first conveying means, there being no change in respect of the leading edge 6 between the first conveying means 1 and the further conveying means 9. It would also be possible, however, for the further conveying means 9 to be operated in the reverse direction, with the result that the products are transported counter to the direction A by this conveying means.

Alternatively, it is also possible, as is indicated by dashed lines in FIG. 3, to provide a further conveying means 10 which, following the pivoting movement, transports the products 2 in the direction of the arrow D, the direction D being oriented counter to the direction C according to FIG. 2. It is thus possible for example, by straightforwardly switching over the direction of the further conveying means 5 (FIG. 2) or 10 (FIG. 3), to produce product streams running in different directions C and D.

In FIG. 4, the operation according to the invention illustrated in FIG. 1 is shown in modified form such that a pivoting operation, about the pivot axis B, assisted by gravitational force takes place not just over an angle range of 90° but over an angle range of 180°. At the same time, during the pivoting of the products 2, which according to FIG. 4 are designed as folded products, these products 2 are opened. In order to allow this opening operation, the products 2, in the region of the conveying means 1, have to have their fold region 11 supported on the supporting lug 3, with the result that the bloom 12 of the products 2 ends up in the radially outward direction during the pivoting movement.

According to FIG. 4, the products 2 are thus pivoted out of an essentially vertical position in which the fold region 11 ends up at the bottom into an again essentially vertical position, although in this case the fold region 11 ends up at the top and the bloom 12, which is now located at the bottom, is open.

Such open products 2 having the bloom 12 oriented downward can easily be deposited, at the end of the pivoting operation according to the invention, on a schematically illustrated saddle conveyor 13, which then transports the products 2 in direction C, preferably perpendicular to the conveying direction A of the conveying means 1.

FIG. 5 corresponds essentially to the illustration according to FIG. 4, the difference being that, in this case, the pivot axis B coincides with the edge of the fold region 11 in the region of the conveying means 1. Furthermore, FIG. 5 also illustrates two gripper fingers 14, 15, and an opening and/or spreading element 16, which pivots along with the products 2. At the beginning of the pivoting movement, the opening and/or spreading element 16 is introduced into the already slightly open product 2, whereupon the two gripper fingers 14, 15 are then closed, with the result that the product 2 is retained between the two gripper fingers 14, 15. During the subsequent pivoting movement, which the products 2, gripper fingers 14, 15 and opening and/or spreading elements 22 execute together, further opening of the products 2 is achieved by virtue of the opening and/or spreading elements 16 being rotated, with the result that, at the end of the pivoting movement, the products 2 can easily be positioned on the saddle conveyor 13. As soon as the open products 2 are positioned above the saddle conveyor 13—aligned with a rest 17 of the saddle conveyor 13—the gripper fingers 14, 15 are opened, with the result that the product 2 drops onto the saddle-like rest 17.

FIG. 6 illustrates an alternative method to FIG. 5 of opening the products 2 which are taking part in the pivoting process.

According to FIG. 6, the products are first of all gripped by the two gripper fingers 14, 15 in the region of their leading edge 6, in relation to the conveying means 1. While the subsequent pivoting movement is executed, an opening and/or spreading element 18 is then moved into the bloom 12 of the products 2, in the direction of the fold region 11 of the latter, perpendicularly to the longitudinal direction of the bloom 12, with the result that the bloom 12 is opened in this way.

The operation of opening products 2 according to FIGS. 5 and 6 can be carried out on products 2 with or without an overfold, in order to allow subsequent processing of the products 2.

FIG. 7 shows that the products 2 pivoted according to the invention, rather than having to be deposited on a further conveying means, can also be deposited, for example, on a stack 19. For further processing, this stack 19 can then be separated, for example, in the downward direction (arrow E). It is also possible, however, for stackwise further processing to take place in the direction of the arrow F.

FIG. 8 shows an illustration, which is more detailed than the figures explained above, of the conveying means 1 comprising an abutment surface 19, which is inclined slightly in relation to the vertical, a supporting lug 3, which projects essentially at right angles in the bottom region of said abutment surface, and a front boundary strip 20. The bottom region of the abutment surface 19, the supporting lug 3 and the boundary strip 20 together form an essentially U-shaped receiving means for a bottom edge of the products 2 transported by the conveying means. In the exemplary embodiment illustrated in FIG. 8, the fold region 11 of the products 2 forms this bottom product edge.

Extending parallel to the abutment surface 19 in the conveying direction A is a belt conveyor 21, which conveys the product 2 and/or displaces the products 2 along the abutment surface 19 in the conveying direction A.

The products 2 illustrated in FIG. 8 are each provided with an overfold 22, which is arranged in each case on that side of the products 2 which is directed toward the abutment surface 19.

Provided level with the overfold 22, at the end of the conveying means 1, is a stop 23, which is of curved configuration (see FIG. 11) such that it forms something of a funnel-like receiving means for the overfold 22.

If the foremost product 2, as seen in the conveying direction A, is intercepted by way of its leading edge 6, in the region of its overfold 22, by the stop element 23, the transporting movement of the product 2 continued by the belt conveyor 21 causes that region of the product 2 which is assigned to the overfold 22 to bulge out in the direction of the intended pivoting movement. Since that region of the product 2 which is not assigned to the overfold 22 ends up beneath the stop 23, and is thus not intercepted by the latter, the abovementioned bulging out causes this region to lift off from the overfold region, which is illustrated, by FIGS. 9, 10 and 11, in method steps which follow quickly one after the other.

It can clearly be seen from FIGS. 8 to 11 that conveying the products 2 against the stop element 23, on the one hand, initiates the pivoting movement according to the invention and, on the other hand, brings about initial opening of the products 2.

FIG. 12 illustrates that the method according to the invention can also be used if the conveying means 1 is designed, for example, as a horizontally oriented conveying belt. In this case, at the end of the conveying belt 1, the products 2 are actively raised and pivoted about the pivot axis B, it being necessary here- to overcome the gravitational force of the products 2 for the first 90° of the pivoting movement. Following this pivoting movement through 90°, the products 2 can then be pivoted further according to the invention, with the assistance of gravitational force.

In order to trigger the active pivoting movement, the conveying means 1 may in turn be provided, at its end, with a stop 24 which causes the products 2 to bulge out upward, with the result that they can easily be gripped by a gripper (not illustrated) and pivoted upward.

DETAILED DESCRIPTION OF THE INVENTION

Not Applicable

What is claimed is:

1. A method of depositing sheet-like products from a conveyor on which they are being conveyed sequentially, one after the other, in a conveying direction comprising the steps of:

a) conveying the sequentially arranged sheet-like products in said conveying direction, at least for a period of time;

b) sequentially pivoting successive products, at least partially with the force of gravity, about an axis which extends parallel to said conveying direction and coincides substantially with a product edge;

c) at least temporarily retaining successive products by means of grippers or supporting means during the pivoting step; and d) depositing each pivoted printed product sequentially on a receiving structure.

2. The method as claimed in claim 1, wherein, immediately prior to a beginning of the depositing operation, the products are oriented horizontally or in a manner inclined in relation to the horizontal, and rest, at least in certain regions, on a conveying means.

3. The method as claimed in claim 2, wherein, during the depositing operation, the products are pivoted through an angle of between 90° and 270°.

4. The method as claimed in claim 1, wherein a further conveying direction of the further conveying means extends substantially perpendicular to said direction.

5. The method as claimed in claim 3 or 4, wherein the products are deposited on a pocket and/or saddle conveyor or on a conveying belt.

6. The method as claimed in claims 1 or 3, wherein, during the conveying process, the products are transported in imbricated formation.

7. The method as claimed in claim 1, wherein, during the pivoting movement, the products are retained at least temporarily at their leading edge, as seen in said conveying direction, by grippers or supporting means, which pivot along with the products.

8. The method as claimed in claim 7, wherein, during the pivoting movement, the products are processed, for example opened, stapled, cut or addressed.

9. The method as claimed in claim 8, wherein, during the pivoting movement, folded products are opened, a fold region of the products coming to lie radially inward in relation to the pivoting movement.

10. The method as claimed in claim 7, wherein, during the pivoting movement, further products are inserted into already open products.

11. The method as claimed in claim 1, wherein, at said beginning of the depositing operation, the products are moved, by way of their leading edge, against a stationary stop, with a result that the products, at least in certain regions, lift off from the conveying means in a pivoting direction.

12. The method as claimed in claim 11, wherein, at said beginning of the depositing operation, products having an overfold are only moved against a stop by way of the leading edge of their overfold region, with the result that a region of the products which is located opposite the overfold lifts off from the overfold region in the pivoting direction and the products are made to open.

13. The method as claimed in claim 1, wherein the products are deposited on a further conveying means.

14. The method as claimed in claim 1, wherein the products are deposited on a product stack.

15. An apparatus for depositing products, in particular printed products, which are taking part in a conveying process, directed in a direction, by means of a conveying means, and follow sequentially one after the other, and which at least temporarily, with support of the gravity force, are pivoted about an axis, which extends essentially parallel to said direction and coincides essentially with a product edge, characterized in that the products are held at least temporarily during the depositing operation by grippers, which are pivoted about said axis along with the products.

16. The apparatus as claimed in claim 15, characterized in that the products are held by said grippers at their leading edge, as seen in said direction.

* * * * *